US006042370A

United States Patent [19]

Weide

[11] Patent Number: 6,042,370

[45] Date of Patent: Mar. 28, 2000

[54] GRAPHITE ROTARY TUBE FURNACE

[75] Inventor: Carl Vander Weide, Lockport, N.Y.

[73] Assignee: Haper International Corp., Lancaster, N.Y.

[21] Appl. No.: 09/378,590

[22] Filed: Aug. 20, 1999

[51] Int. Cl.[7] ..... F22B 7/00

[52] U.S. Cl. ..... 432/103; 432/105; 432/107; 432/112; 432/113; 432/116; 432/118

[58] Field of Search ..... 432/103, 104, 432/105, 107, 109, 112, 113, 114, 115, 116, 117, 118; 373/113, 125, 126; 219/390, 391, 388

[56] References Cited

U.S. PATENT DOCUMENTS

| | | | |
|---|---|---|---|
| 4,961,391 | 10/1990 | Mak et al. | 110/346 |
| 5,244,274 | 9/1993 | Onodera | 366/147 |
| 5,393,225 | 2/1995 | Freiberger et al. | 432/103 |
| 5,711,664 | 1/1998 | Jegou et al. | 432/116 |
| 5,733,115 | 3/1998 | Petersen | 432/103 |

*Primary Examiner*—Denise L. Ferensic
*Assistant Examiner*—Jiping Lu
*Attorney, Agent, or Firm*—Arthur S. Cookfair; James J. Ralabate

[57] ABSTRACT

A rotary tube furnace suitable for operation in controlled atmospheres at temperatures in the range of 1500° to 2800° comprises a generally horizontal rotatable graphite tube slidably supported on water-cooled split ring graphite bearings. The graphite tube is rotated by means of a stainless steel drive plate and is contained within a flexible atmospheric sealing assembly and enclosure for the containment of a selected atmosphere around and within the tube and allows for the co-current or counter-current flow of gas during operation. Radiation baffles in the interior of the graphite tube inhibit radiant heat loss at the ends of the tube. The graphite tube may be constructed in two or more sections having threaded ends for ease of installation as well as removal or replacement for maintenance purposes. A heating section of the tube is heated by a plurality of graphite electrical heating elements contained within an insulated heating chamber.

20 Claims, 2 Drawing Sheets

GRAPHITE ROTARY TUBE FURNACE

BACKGROUND OF THE INVENTION

1. Field of the Invention

This invention relates to a graphite rotary tube furnace for the high temperature treatment of various materials in an inert atmosphere.

2. Prior Art

The processing of materials at very high temperatures, for example, at temperatures of from about 1500° C. to temperatures as high as 3000° C. or higher presents a number of problems that must be overcome in the design of the process equipment to be used. Firstly, the choice of construction materials is limited. Graphite is often the material of choice when extreme temperatures are used. Such elevated temperatures frequently require that the treatment be carried out in an inert atmosphere, for example, a non-oxidizing atmosphere to avoid undesired reactions with the material being processed. In addition, when the equipment is constructed of graphite, the material of construction itself may react with the oxygen in air at extremely high temperatures. Thus it may be necessary, or preferable, to provide an inert atmosphere enveloping the graphite equipment as well as the material being processed. In the case of moving equipment, such as the graphite rotary tube furnace of the present invention, the maintenance of an inert atmosphere both within the tube and surrounding the graphite tube during operation presents particular difficulties.

The use of graphite in tubular reactors is known in the literature. U.S. Pat. No. 3,656,910 to Ferment discloses a graphite tube furnace for the production of carbonaceous fibrous material.

U.S. Pat. No. 5,144,108 to Passarotto discloses a rotating tube furnace having interior rotating paddles to aid in the transit of material through the tube.

U.S. Pat. No. 4,988,289 to Coucher discloses a reaction furnace comprising a rotating core within a heated shell. Blade segments in side of the tube are arranged in a helical pattern to aid in the moving of materials through the tube.

U.S. Pat. No. 5,251,231 to Croker et al. discloses a furnace having a cooling fluid (water) surrounding the entire furnace.

U.S. Pat. 5,393,225 to Freiberger et al. discloses a rotating tubular kiln comprising a replaceable rotating tube surrounded by a tubular jacket and separated therefrom by a gap.

There remains a need for an improved rotary furnace or kiln suitable for the treatment of particulate materials at very high temperatures in a controlled atmosphere.

It is an object of the present invention to provide a graphite rotary tube furnace suitable for continuous operation at temperatures up to 3000° C. or higher.

It is a further object of the invention to provide a high performance ultra high temperature rotary tube furnace utilizing conveniently replaceable components.

It is a still further object of the invention to provide a mechanically driven graphite rotary tube furnace wherein both the product being treated and the furnace components may be contained in a controlled atmosphere at high temperatures while the furnace is rotated.

A still further object is to provide a graphite rotary tube furnace characterized by excellent thermal efficiency and capable of providing single or multiple temperature control zones.

It is a further object to provide a rotary tube furnace capable of operating at high temperature wherein radiation heat loss at the ends of the tube is minimized.

SUMMARY OF THE INVENTION

The above and other objects are achieved in accordance with the present invention which provides a rotary tube furnace suitable for operation in controlled atmospheres at high temperatures comprising: a generally horizontally extending rotatable graphite tube having a feed entrance zone, a heating zone, and a product discharge zone supported on a plurality of graphite bearings which may have cooling means associated therewith; a drive plate indirectly attached to the graphite tube for imparting rotational motion thereto; a flexible atmospheric sealing assembly for containing a selected atmosphere around and within the graphite tube during rotation; a thermally insulated heating chamber surrounding the heating section; and at least one heating element within the heating chamber.

The graphite rotary tube furnace of the present invention is suitable for he treatment of particulate material at temperatures as high as 3000° Celsius or higher and preferably in the temperature range of from about 1500° C. to about 2800° C.

The graphite bearings on which the graphite tube rests, may be in the form of a half ring, fitting around the lower portion of the circumference of the tube to provide support for the tube and to provide a surface on which the tube may slidably rotate. Preferably, the graphite bearings are in the form of full graphite rings, fitted to the circumference of the tube and preferably split, for ease of installation. In a preferred embodiment, the rotatable graphite tube is supported on split ring graphite bearings mounted in split ring water-cooled jacket supporting structures. In addition, the water-cooled jackets may be horizontally extended to provide product cooling, for example, at the product discharge end.

The graphite tube may be a single unit of the desired length, or preferably, may be in the form of a multiplicity of interconnectable sections of graphite tube to allow for ease of construction or for removal and replacement as required for maintenance or other purposes. Preferably the graphite tube comprises two or more, most preferably three, sections, threaded or otherwise removably attachable at the ends to allow joining of the sections.

In a preferred embodiment, the graphite tube includes a multiplicity of semi-circular radiation baffles attached around the interior perimeter to block direct radiation from the furnace heating sections, thus keeping the feed entrance end and the product discharge end cooler and minimizing radiation heat loss at the ends. The radiation baffles may be made of a suitably heat resistant material, such as tantalum, zirconium, or preferably, graphite.

The heating zone, which may include one or more graphite tube sections, may be heated with a multiplicity of heating elements, preferably graphite electrical heating elements, typically either rod or plate type design with single or multiple power connections mounted either horizontally or vertically or both, outside of the tube within the heating chamber. The configuration of heating elements may be arranged to provide flexibility for single or multiple temperature zones within the heating chamber, allowing for thermal profiling and scaling up capabilities. For example, a multiplicity of heating elements may be arranged to allow for greater power input where needed to compensate for heat loss near the ends of the heating chamber and thus maintain a constant temperature throughout. Alternatively, variations in power input may be made to allow for gradual increase or decrease in temperature as particulate material passes through the heating zone. If desired, the heating chamber may be divided into temperature zones which may be separated by insulation barriers which would allow greater temperature definition for thermal profiling.

Each end of the graphite tube is enclosed in, or surrounded by, a hood for the containment of atmosphere, dust and the like. The heating chamber, the flexible atmospheric sealing assembly, the hood at each end, and the water-cooled jackets around the split ring bearings, collectively, form an enclosure to maintain a selected atmosphere around and within the graphite tube.

The drive plate is made of heat resistant material, preferably a stainless steel, suitable for withstanding the high temperatures at which the furnace may be operated. The drive plate is preferably connected indirectly to the graphite tube by means of a keyway or splined connection that allows for the difference in expansion and contraction between the metal drive plate and the graphite tube. In operation, the drive plate serves to transmit rotational torque to the graphite tube, imposed by a sprocket, gear or other drive device connected to the drive plate. An atmospheric seal is obtained and maintained during rotation by means of graphite ring or rings located on either side or both of the drive plate and pressed against the drive plate by means of one or more flexible bellows or other means capable of providing a spring type force against the graphite ring(s). Moreover, this flexible sealing assembly serves to impart a horizontal force against the other components of the aforementioned enclosure to maintain an atmospheric seal around the graphite tube during operation, compensating for thermal expansion and contraction and some eccentricity of rotation.

BRIEF DESCRIPTION OF THE DRAWINGS

The present invention and the manner in which it may be practiced is further illustrated with reference to the accompanying drawings wherein.

DETAILED DESCRIPTION OF THE INVENTION AND PREFERRED EMBODIMENTS

Figure 1:
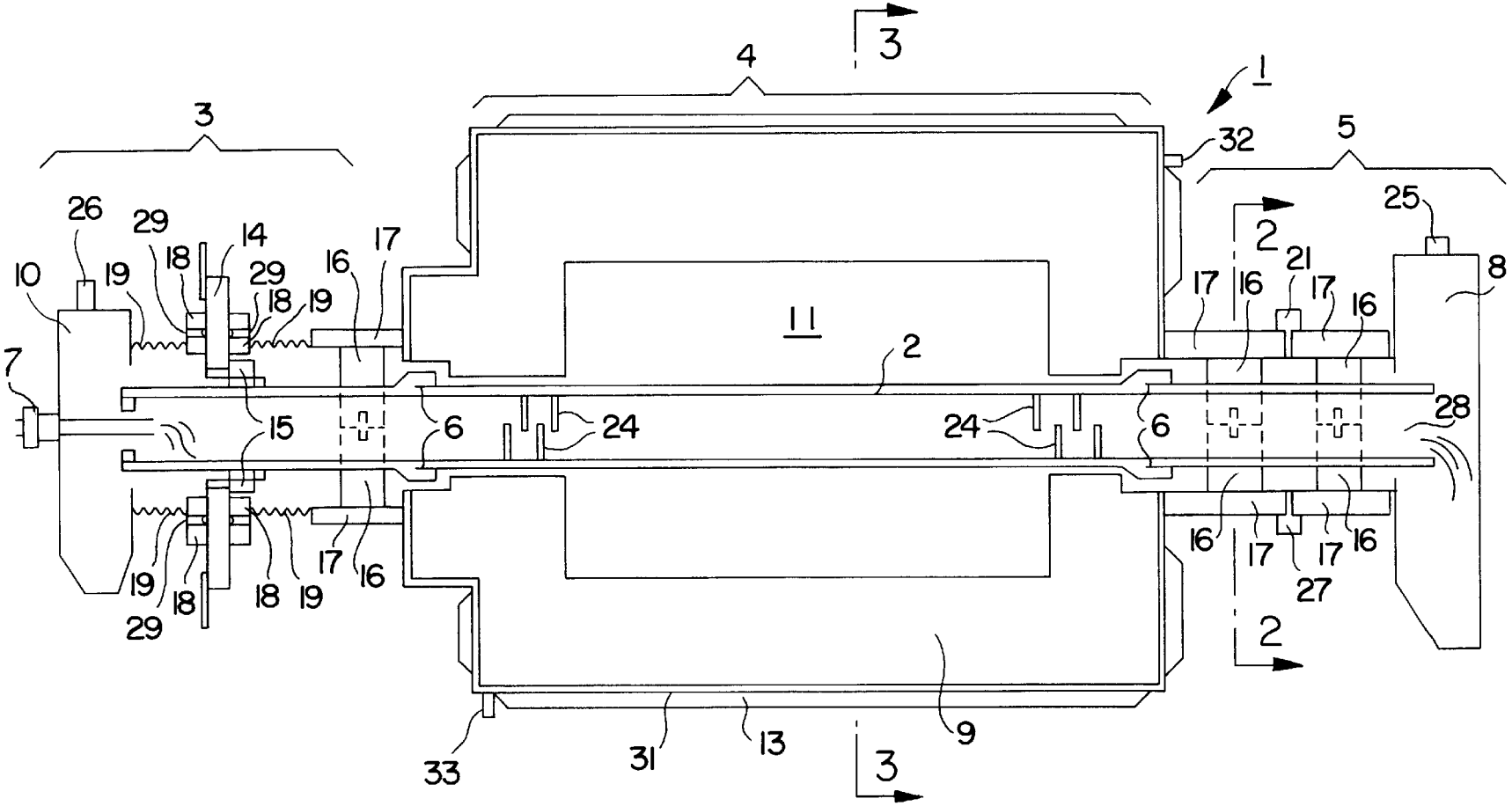
FIG. 1 shows a sectional side view of a graphite rotary tube furnace of the present invention.
Figure 2:
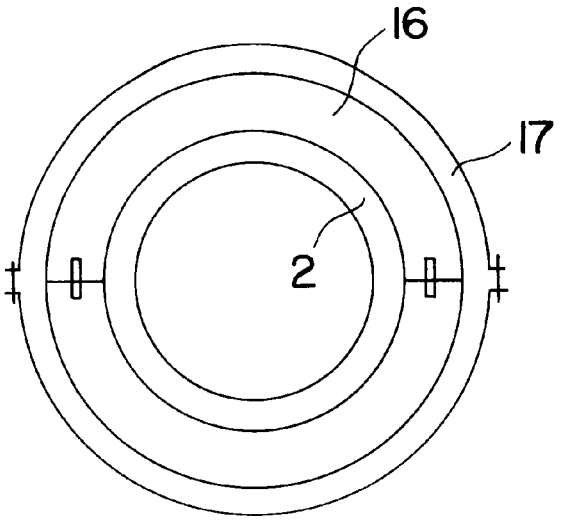
FIG. 2 is a cross-sectional view of the graphite rotary tube furnace of the present invention taken along the reference line 2—2' of FIG. 1.

In FIG. 1 a side sectional view of a graphite rotary tube furnace 1 of the present invention includes a graphite tube 2 comprising an entrance zone 3, a heating zone 4 and a product discharge zone 5. It will be appreciated by those skilled in the art that, although the graphite rotary tube furnace of this invention is referred to and illustrated as substantially horizontal, it may, in practice, be tilted from the horizontal to aid in the movement of materials therethrough. In the embodiment depicted, the graphite tube 2 is assembled from three sections joined by means of threaded joints 6. However, in other embodiments, the graphite tube 2 may be constructed as a single unit or of any multiplicity of sections, depending on various considerations, such as the total length required and variations in the treatment of product along the length, resulting in different replacement schedules for maintenance purposes.

Figure 3:
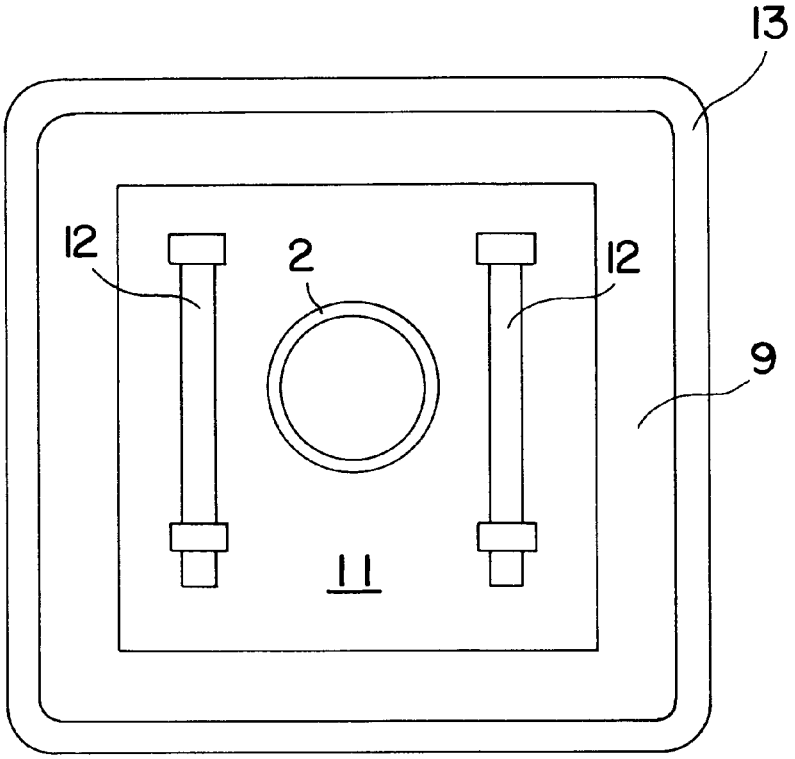
FIG. 3 is a cross-sectional view of the heating section of the furnace of the present invention taken along the reference line 3—3'.

Material, such as particulate material, to be treated may be introduced through material inlet 7 in hood 10 at the entrance zone 3 and discharged at product discharge zone 5 through hood 8 and collected in a container (not shown) attached thereto. The heating section 4 comprises a heating chamber 11 within insulation enclosure 9 which, in turn, may be enclosed in a metal shell 31 which may be of a suitably heat resistant material, such as stainless steel. The heating chamber 11 may contain one or more electrical heating elements 12. (FIG. 3.) The insulation enclosure 9 is a high temperature insulation, such as graphite or a suitable fibrous insulation such as carbon (or graphite) fiber insulation. In a preferred embodiment, the graphite insulation 9 may be further encased in a water cooled outer shell 13 which may be made of a heat resistant material such as stainless steel.

The graphite tube 2 is rotated by means of a drive plate 14 preferably of stainless steel. The drive plate 14 may be attached to the graphite tube 2, indirectly through a keyed or splined or similar connection 15 to transmit rotational torque from a motor source (not shown) through the drive plate to the graphite tube, while allowing for differences in thermal expansion.

The graphite tube 2 is supported by split graphite ring bearings 16 at two or more positions along its length. In the preferred embodiment, as illustrated, the graphite bearings are mounted in split ring water-cooled jackets 17 to maintain the bearings at a lower temperature. In addition to providing a cool temperature for the graphite bearings, water-cooled jackets may be extended to provide cooling zones in various parts of the furnace. Thus, for example, in the embodiment depicted in FIG. 1, the split ring water-cooled jackets 17 are extended horizontally to provide additional cooling at the product discharge zone to bring the product to a desired lower temperature as it exits the furnace at product outlet 28. Furthermore, in the embodiment illustrated, a gas inlet 21 and gas outlet 27 are provided to allow the passage of cooling gas therethrough between the graphite bearings to further aid in the cooling of the product as it passes through the product discharge zone 5 prior to exiting the furnace at product at product outlet 28.

In some embodiments it may be preferable to omit the water-cooled jackets over some graphite bearings. For example, in the case of longer graphite tube embodiments, where it may be necessary to provide additional support by placing additional graphite bearings within the heating chamber 11, it may be preferred to omit the water-cooled jackets around those bearings within the heating chamber. Also, if higher product discharge temperatures are desired, the water-cooled jackets 17 around the graphite bearings 16 in the product discharge end 5 may be made smaller or omitted.

In operation, at high temperatures, it is preferred to maintain a non-oxidizing atmosphere, such as nitrogen, argon, or the like, in the interior of the graphite tube 2 as well as on the exterior to protect against oxidation of the graphite. The interior atmosphere may be controlled by passing a non-oxidizing gas, such as nitrogen, for example, in a counter-current direction, with the gas entering through inlet port 25 in hood 8 in the discharge zone 5 and exiting through outlet port 26 in hood 10 in the entrance zone 3. If a co-current gas flow is desired, inlet port 25 and outlet port 26 may be reversed in function so that gas flow is in the opposite direction. In addition, inlet port 25 and outlet port 26 may also be used to pass selected reactive gases through the interior for specific treatments of the material passing through.

The outer surface of graphite tube 2 may be protected against oxidation or other undesired chemical reactions with the graphite by maintaining a non-oxidizing atmosphere, such as an atmosphere of nitrogen, argon or the like in the space surrounding the graphite tube especially in the heating zone 4 where higher temperatures tend to intensify the problem. A positive pressure of gas may be maintained throughout the heating chamber 11 using gas inlet/outlet passageways 32 and 33. During rotation of the graphite tube 2, when some eccentricity of motion may occur, an atmospheric seal is maintained with the aid of a flexible gas tight seal comprising graphite sealing rings 18 slidably pressed against either or both sides of the drive plate 14 with one or more flexible bellows 19, or other spring-loaded sealing assembly, to impart a positive sealing spring type force. The bellows 19, or other sealing assembly means, as well as the drive plate 14 are preferably made of stainless steel to withstand the conditions of operation of the furnace. Preferably, a gas inlet 29 is provided within graphite sealing rings 18 for the transmission of an inert gas, such as nitrogen, argon, or the like to maintain a positive pressure of the inert gas around the drive plate 14 and the outside of the graphite tube 2 in the region of the product entrance end 3 of the furnace.

The heating element(s) 12 mounted within the heating chamber 11 are preferably electrical heating elements and, most preferably graphite heating elements. They may be mounted vertically or horizontally or both. They may be powered and positioned as desired to provide a single constant temperature throughout the heating section 4 or to provide multiple temperature zones for thermal profiling.

To prevent excessive radiation heat loss at the ends of the graphite tube 2 there may be installed a multiplicity of semicircular radiation baffles 24 made of suitably heat resistant material, such as tantalum, zirconium, or the like, or preferably, graphite. The baffles may be attached, for example by cementing, along the interior perimeter of the graphite tube to block direct radiation heat loss from the heating section 4 through the ends of the tube.

Although the invention has been described with reference to certain preferred embodiments, it will be appreciated by those skilled in the art that modifications and variations may be made without departing from the spirit and scope of the invention as defined by the appended claims.

What is claimed is:

1. A rotary tube furnace comprising:

a generally horizontally extending rotatable graphite tube having a feed entrance zone, a heating zone, and a product discharge zone;

a plurality of graphite bearings slidably supporting said rotatable graphite tube;

at least one of said graphite bearings being cooled by a water-cooled jacket;

a drive plate attached to said graphite tube to transmit rotational torque thereto;

an enclosure around said graphite tube adapted to maintain a selected atmosphere around and within said graphite tube, said enclosure including two graphite rings, each pressed against an opposite side of said drive plate by a flexible atmospheric sealing assembly to maintain a slidable sealing relationship between said graphite rings and said drive plate;

an insulated heating chamber around said heating zone containing one or more heating elements;

gas inlet and outlet means for the entry and exit of gas to supply a selected atmosphere to said enclosure.

2. A rotary tube furnace according to claim 1 wherein said graphite tube has a multiplicity of radiation baffles attached to an inner surface thereof to inhibit a loss of radiant heat at said feed entrance end and said product discharge end.

3. A rotary tube furnace according to claim 1 wherein said graphite tube comprises two or more tube sections.

4. A rotary tube furnace according to claim 3 wherein said tube sections are provided with threaded ends for attachment and removal.

5. A rotary tube furnace according to claim 3 wherein said graphite tube comprises three removable and replaceable sections.

6. A rotary tube furnace according to claim 5 wherein said tube sections are provided with threaded ends for attachment and removal.

7. A rotary tube furnace according to claim 2 wherein said radiation baffles are made of graphite.

8. A rotary tube furnace according to claim 1 wherein said flexible atmospheric sealing assembly comprises at least one bellows positioned concentrically around said graphite tube and exerting a spring-like force against one of said graphite rings to maintain a slidable sealing relationship between said graphite rings and said drive plate.

9. A rotary tube furnace according to claim 8 wherein said atmospheric sealing assembly comprises two of said bellows, each pressed against one of said graphite rings on opposite sides of said drive plate to maintain a slidable sealing relationship between said graphite rings and said drive plate.

10. A rotary tube furnace according to claim 9 wherein said enclosure around said graphite tube comprises an assemblage of components including a first hood at an end of said entrance zone of said graphite tube, a second hood at an end of said product discharge zone of said graphite tube, one or more water cooled jackets, an insulated heating chamber around said heating zone, said two graphite rings, said drive plate, said components being maintained in a sealing relationship by a spring-like force from said flexible atmospheric sealing assembly.

11. A rotary tube furnace according to claim 10 wherein said insulated heating chamber includes a gas inlet and gas outlet to allow the entry and exit of gas to maintain a selected atmosphere around said graphite tube in said heating chamber.

12. A rotary tube furnace according to claim 11 wherein said heating chamber contains a multiplicity of heating elements capable of providing a multiplicity of temperature zones within said heating zone.

13. A rotary tube furnace according to claim 10 wherein said first hood and said second hood each include a gas port for the entry or exit of gas to provide a co-current or counter-current flow of gas through said graphite tube.

14. A rotary tube furnace according to claim 3 wherein said graphite rings each include a gas entryway for the transmission and maintenance of a positive pressure of gas against said drive plate.

15. A rotary tube furnace according to claim 1 wherein said product discharge zone includes a cooling means.

16. A rotary tube furnace according to claim 1 wherein said graphite bearings are split ring graphite bearings.

17. A rotary tube furnace according to claim 16 wherein each of said split ring bearings are surrounded by a split ring water cooled jacket.

18. A rotary tube furnace comprising:

a generally horizontally extending rotatable graphite tube comprising two or more removable and replaceable tube sections, said graphite tube having a feed entrance zone, a heating zone, and a product discharge zone;

a multiplicity of graphite radiation baffles attached to an inner surface of said graphite tube to inhibit a loss of radiant heat;

a plurality of split ring graphite bearings slidably supporting said rotatable graphite tube, at least one split ring bearing being within said entrance zone and at least one split ring bearing being within said product discharge zone;

each of said split ring graphite bearings within said entrance zone and said product discharge zone, being surrounded by a water-cooled jacket;

a stainless steel drive plate attached to said graphite tube to transmit rotational torque thereto, said drive plate being attached to said graphite tube by a keyway or spline connection to allow for differences in thermal expansion or contraction;

an enclosure around said graphite tube adapted to maintain a selected atmosphere around and within said graphite tube, said enclosure comprising two graphite rings, each pressed against an opposite side of said drive plate by a flexible atmospheric sealing assembly to maintain a slidable sealing relationship between said graphite rings and said drive plate, a first hood at an end of said entrance zone of said graphite tube, a second hood at an end of said product discharge zone of said graphite tube, at least two of said water-cooled jackets, an insulated heating chamber around said heating zone, said two graphite rings, and said drive plate, said components being maintained in a sealing relationship by a spring-like force from said flexible atmospheric sealing assembly;

gas inlet and outlet means in said insulated heating chamber for the entry and exit of gas to provide a selected atmosphere within said heating chamber;

a first gas port in said first hood and a second gas port in said second hood for the entry or exit of gas to provide a co-current or counter-current flow of gas through said graphite tube;

a gas entryway within each of said graphite rings for the transmission and maintenance of a positive pressure of gas against said drive plate.

19. A rotary tube furnace according to claim 18 wherein said graphite tube comprises three removable and replaceable tube sections.

20. A rotary tube furnace according to claim 18 wherein said flexible atmospheric sealing assembly comprises two metal bellows, each providing a spring-like expansive force pressing in one direction against one of said graphite rings on opposite sides of said drive plate to maintain a slidable sealing relationship between said graphite rings and said drive plate and in an opposite direction against another of said components of said enclosure.

* * * * *

UNITED STATES PATENT AND TRADEMARK OFFICE

CERTIFICATE OF CORRECTION

PATENT NO. : 6,042,370
DATED : March 28, 2000
INVENTOR(S) : Carl Vander Weide

It is certified that error appears in the above-identified patent and that said Letters Patent is hereby corrected as shown below:

Title page,
Item [73], should read

-- [73] Assignee: Harper International Corp., Lancaster, N.Y. --

Signed and Sealed this

Third Day of June, 2003

JAMES E. ROGAN
*Director of the United States Patent and Trademark Office*